US005791083A

United States Patent [19]

Giangrossi

[11] Patent Number: 5,791,083

[45] Date of Patent: Aug. 11, 1998

[54] CHRISTMAS TREE WATERING APPARATUS WITH LEVEL INDICATOR

[76] Inventor: Kenneth P. Giangrossi, 3930 Shamrock, Boise, Id. 83713

[21] Appl. No.: 766,159

[22] Filed: Dec. 12, 1996

[51] Int. Cl.[6] ..... A47G 7/02

[52] U.S. Cl. ..... 47/40.5

[58] Field of Search ..... 47/40.5

[56] References Cited

U.S. PATENT DOCUMENTS

| | | | |
|---|---|---|---|
| 4,850,137 | 7/1989 | Foster | 47/40.5 |
| 5,076,009 | 12/1991 | Cibor | 47/40.5 |
| 5,410,839 | 5/1995 | Granger | 47/40.5 |
| 5,473,838 | 12/1995 | Denbigh | 47/40.5 |
| 5,535,547 | 7/1996 | Brunengo | 47/40.5 |

*Primary Examiner*—Terry Lee Melius

*Assistant Examiner*—Joanne C. Downs

*Attorney, Agent, or Firm*—Joseph W. Holland

[57] ABSTRACT

A device for monitoring and maintaining the water level in the reservoir of a Christmas tree stand having a filler portion communicating with a flexible filler conduit. A water level indicator, includes an indicator float which is slideably engaged within the indicator float housing and which travels freely along a substantially vertical axis within the indicator float housing, a flexible indicator stem is attached to the indicator float and extends up through a flexible conduit for indicating, by means of the relative extension of the flexible indicator stem, the water level in the tree stand reservoir. The indicator float housing is formed having a number of holes through its outer wall for the free passage of water in and out of the indicator float housing from the reservoir for buoyantly raising or lowering the indicator float, consistent with the level of water in the reservoir.

16 Claims, 3 Drawing Sheets

CHRISTMAS TREE WATERING APPARATUS WITH LEVEL INDICATOR

This application claims the benefit of U.S. Provisional Application No. 60/024,317, filed Aug. 22, 1996.

DESCRIPTION

BACKGROUND OF THE INVENTION

1. Technical Field

The present invention relates generally to devices for watering plants, and more specifically, to a device for monitoring and maintaining the water level in the reservoir of a Christmas Tree stand.

2. Background

Annually, millions of homes and businesses erect a cut natural tree, typically a fir or pine, as a part of the annual Christmas tradition. The cut tree is erected oftentimes, by securing the base of the tree in a stand, the stand having integral to its manufacture, a reservoir for providing a supply of water to the cut tree for maintaining the tree's foliage throughout the Christmas holiday. Typically the reservoir has a capacity which is adequate to provide for the tree's water requirement for several days, depending upon ambient conditions and the size and needs of any particular tree. However, trees are often erected early in the season and left inside a home or business for weeks before being taken down. The need to monitor and maintain a tree's water supply arises repeatedly during the holiday season.

It is widely recognized that trees that are left to dehydrate pose a fire hazard within the home or business. Additionally, when a tree dries out it begins to loose its foliage and rapidly becomes less attractive.

Traditionally, the chore of monitoring a tree's water supply has involved crawling on hands and knees below the tree, uncovering the base of the tree which oftentimes is festooned with a decorative apron and surrounded with presents in order to ascertain the water level within the reservoir generally by placing a hand into the reservoir to determine the relative depth of the water. Similarly, the chore of maintaining a tree's water supply has been as cumbersome a task as monitoring the water level, with water being added typically with a pitcher or other vessel often resulting in overfilling and spilling.

One solution suggested to address the problems outlined above is found in Granger, U.S. Pat. No. 5,410,839, which discloses an apparatus for maintaining a water supply within a tree stand having a rigid funnel body including integrally formed top center and bottom portions having a conical cross section that tapers from top to bottom. A flexible coupling is integrally formed between the portions of the funnel body to hold the portions in a desired angular relationship. A float assembly is pivotally attached to the bottom portion of the body and is coupled to a light assembly which is affixed to the top portion of the funnel body to indicate the water level in the tree stand. The light assembly includes a light circuit having a lot watt bulb, a power source and a switch.

What is needed is an apparatus for monitoring and maintaining the level of water in the reservoir of a Christmas tree stand which has a minimum of moving parts, which does not require or include a valve means or any electrical or electronic circuitry and which is readily employed and simple to use.

Another object of the invention is to provide an apparatus for maintaining the water supply for a Christmas tree that allows the user to replenish the water supply without having to uncover the base of the tree or tree stand or crawl underneath the tree.

Another object of the invention is to provide an apparatus for maintaining the water supply for a Christmas tree that may be attached to the tree by the owner or alternatively at the point of sale and used with many existing Christmas tree stands.

An alternative object of the invention is to provide an apparatus for maintaining the water supply for a Christmas tree that is constructed entirely from biodegradable materials so that the apparatus may be recycled with the tree at the end of the holiday season.

An additional object of the invention is to provide an apparatus for maintaining the water supply for a Christmas tree that may be manufactured integrally into a Christmas tree stand.

Additional objects, advantages and novel features of the invention will be set forth as part of the description that follows and, in part, will become apparent to those skilled in the art upon examination of the following or may be learned by practice of the invention.

SUMMARY

These and additional objects are achieved by a Christmas tree watering device having a water level indicator. The device includes a filler portion having a filler discharge portion in fluid communication with an indicator float housing via a flexible filler conduit. The filler portion is formed of a funnel that tapers from top to bottom. In the alternative, the filler portion may be formed having an external design element consistent with the Christmas holiday theme. The flexible filler conduit is coupled to the filler discharge portion or manufactured integrally as an extension of the filler portion.

The invention further includes means for indicating the water level within the tree stand reservoir including an indicator float manufactured of a buoyant material such as polypropylene. A flexible indicator stem is attached to the indicator float and extends up through a conduit for indicating, by means of the relative extension of the flexible indicator stem, the water level in the tree stand reservoir. The flexible indicator stem may be manufactures using a nylon or other synthetic monofilament.

The indicator float is slideably engaged and travels freely along a substantially vertical axis within an indicator float housing which is coupled to and is in fluid communication with the conduit through which the flexible indicator stem extends. The indicator float housing provides protection for the indicator float, supporting the indicator float within the tree stand reservoir. The indicator float housing has formed in it, a plurality of apertures allowing for a free flow of water from the housing to the reservoir and from the reservoir through the outer wall of the housing so that the level of water within the housing is maintained at the same level as the water within reservoir. As the indicator float rises or falls within the indicator float housing, the flexible indicator stem extends or retracts accordingly to provide an accurate indication of the water level. The indicator float housing is sized and configured so that it may be introduced readily into the top opening of many commercially available tree stands having a reservoir. As such, the indicator float housing may have a cross section which is circular, crescent shaped or shaped in any of a variety of configurations which allow introduction of the indicator float housing into the tree stand reservoir.

In the preferred embodiment of the invention, the indicator float housing is coupled to and is in fluid communication with the flexible filler conduit. In the preferred embodiment of the invention, the indicator float housing is configured internally having a first chamber and a second chamber. A partition having an aperture formed through its cross section for passage of a flexible indicator stem divides the first and second chambers. The first chamber is defined by a first chamber exterior wall which in the preferred embodiment of the invention, is a segment of the exterior wall of the float indicator housing and the partition. The first chamber has at least one aperture through the first chamber exterior wall for passage of water to the reservoir. The indicator float housing also includes a second chamber defined by a second chamber exterior wall, which in the preferred embodiment of the invention, is a segment of the exterior wall of the float indicator housing and the partition. The second chamber similarly has at least one aperture through the second chamber exterior wall for passage of water to and from the reservoir to the second chamber for buoyantly raising or lowering the indicator float, consistent with the level of water in the reservoir.

Various configurations of the invention are possible including a first chamber and second chamber wherein the first chamber is an upper chamber and the second chamber is a lower chamber, or in the alternative where the first chamber is an inner chamber and the second chamber is a outer chamber. Additionally, the device may include a shroud or other means for directing the flow of water in a downward direction after discharge from the first chamber aperture.

In the preferred embodiment of the invention, the flexible filler conduit may be attached along the length of its outer periphery to the tree. Means for attaching the device are provided in the form of a pair of straps.

In an alternate embodiment of the invention, the indicator float housing is coupled to and communicates with a flexible indicator conduit. The filler portion having the filler discharge portion is in fluid communication with a separate flexible filler conduit. The second end of the flexible filler conduit in the alternate embodiment is placed directly within and discharges directly into the reservoir.

The invention may be incorporated in a variety of embodiments including a version that is constructed entirely as a stand alone unit for use with a range of existing tree stands having reservoirs or a version that may be manufactured integrally into a Christmas tree stand having a reservoir. The device includes straps or other means for releasably attaching the device to the tree.

DETAILED DESCRIPTION OF THE INVENTION

Figure 1:
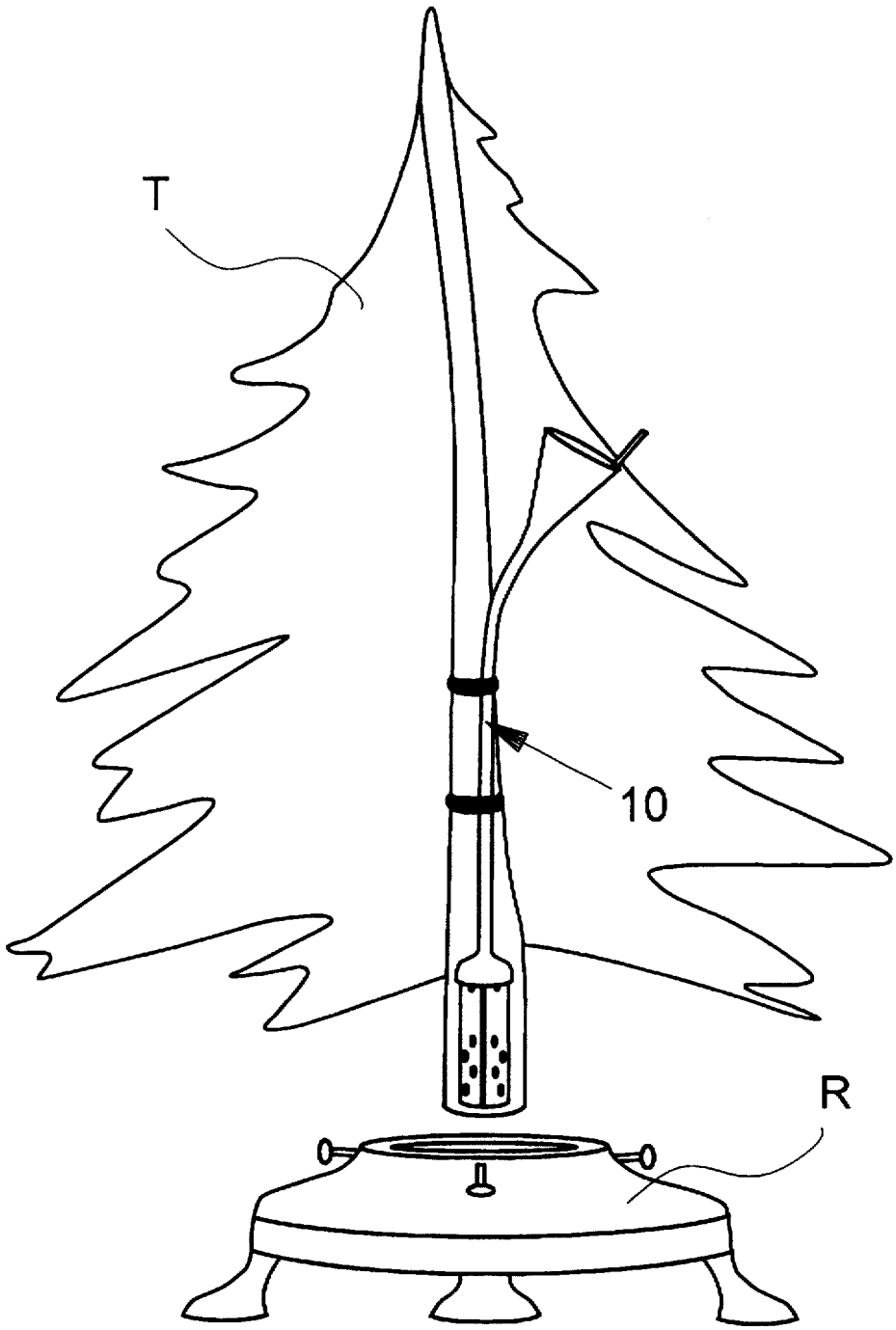
FIG. 1 is a perspective representational view of the preferred embodiment of the tree watering apparatus with level indicator.
Figure 2:
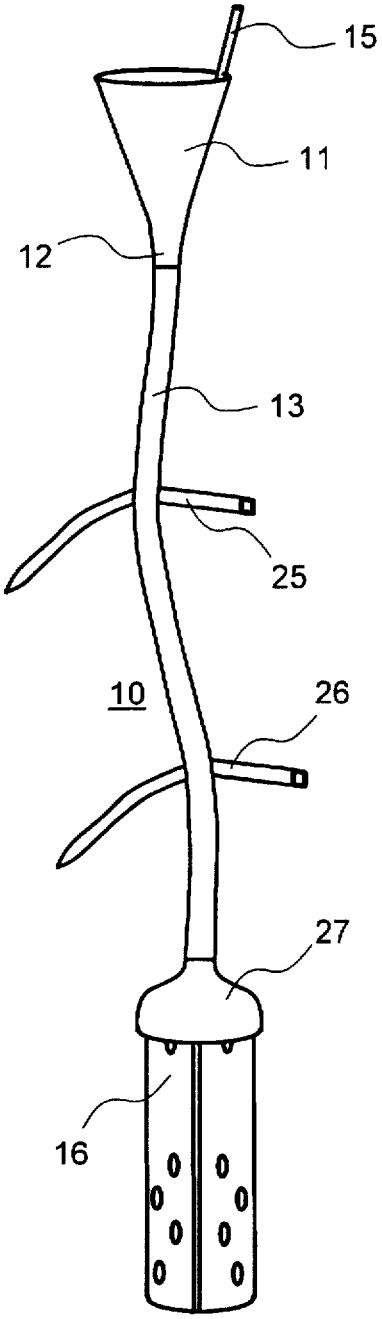
FIG. 2 is a perspective representational view of the preferred embodiment of the tree watering apparatus with level indicator.
Figure 4:
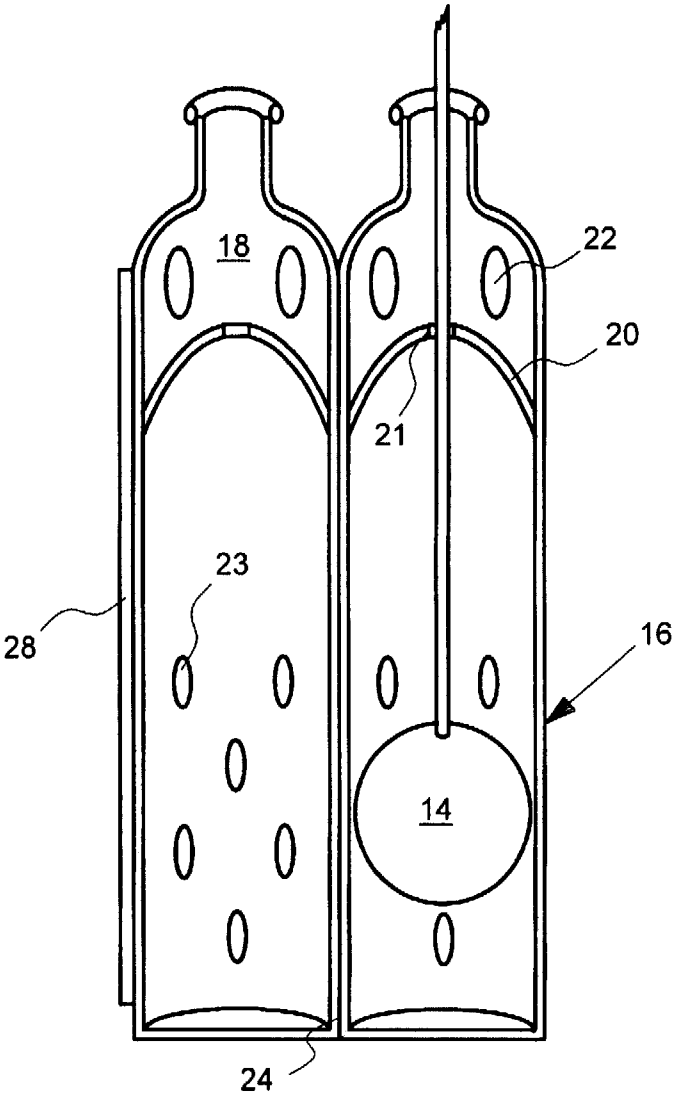
FIG. 4 is a detail perspective representational view of the preferred embodiment of the float indicator housing.

Referring now to FIGS. 1, 2 and 4, the preferred embodiment of tree watering device 10 will be described in detail. The device includes filler portion 11 having filler discharge portion 12 in fluid communication with within indicator float housing 16 via flexible filler conduit 13. Filler portion 11 may be formed of a funnel having a frusto-conical cross-section that tapers from top to bottom. Flexible filler conduit 13 is coupled to filler discharge portion 12 or manufactured integrally as an extension of filler portion 11.

Indicator float 14 is attached to flexible indicator stem 15 and extends up through flexible filler conduit 13 for indicating, by means of the relative extension of flexible indicator stem 15 at the upper open end of filler portion 11, the water level in reservoir R.

In the preferred embodiment of the invention, indicator float 14 is contained and travels freely along a substantially vertical axis within indicator float housing 16 which is coupled to and is in fluid communication with flexible filler conduit 13.

In the preferred embodiment of the invention, indicator float housing 16 is configured internally having upper chamber 18 and lower chamber 19. Partition 20 having stem aperture 21 formed through its cross section for passage of flexible indicator stem 15 divides upper chamber 18 and lower chamber 19. The walls of upper chamber 18 are defined by that upper portion of indicator float housing 16 located above partition 20. Similarly, the walls of lower chamber 19 are defined by that lower portion of indicator float housing 16 located below partition 20. Upper chamber 18 is formed has a plurality of discharge apertures 22 through the walls of upper chamber 18 for passage of water from flexible filler conduit 13 through upper chamber 18 discharging through discharge aperture 22 to reservoir R. Lower chamber 19 is formed having a plurality of inflow apertures 23 through indicator float housing 16 for passage of water from reservoir R into lower chamber 19 for buoyantly raising or lowering indicator float 14, consistent with the level of water in reservoir R.

Tree watering device 10 may be attached to tree T by straps 25 and 26 attached along the length of flexible filler conduit 13.

Referring to FIG. 2, shroud 27 is seen attached at the upper end of indicator float housing 16 for directing the flow of water in a downward direction after exiting from discharge aperture 22.

Referring again to FIG. 4, indicator float housing 16 is manufactured by molding in two half sections connected by hinge 24. Snap closure 28 allows the two half sections to be fastened together when closed forming a substantially cylindrical section.

Figure 3:
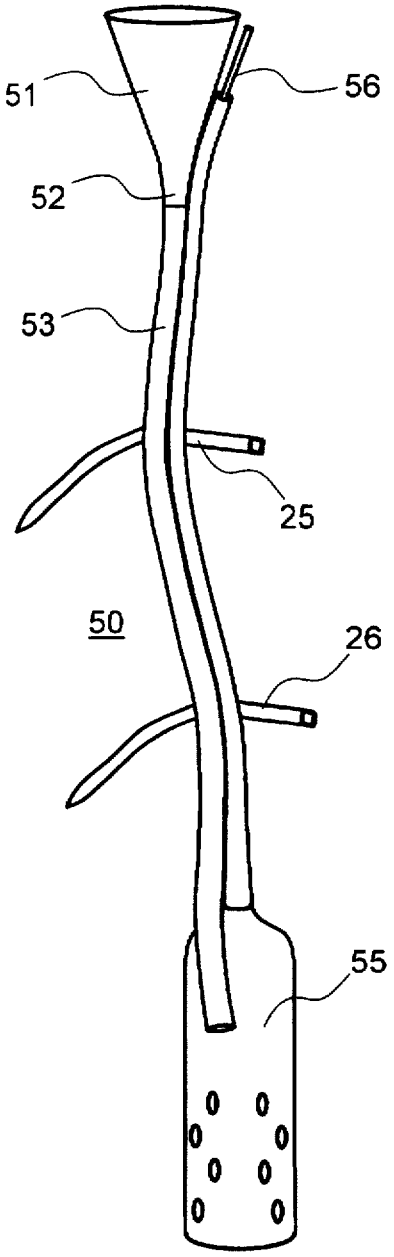
FIG. 3 is a perspective representational view of an alternate embodiment of the tree watering apparatus with level indicator.
Figure 5:
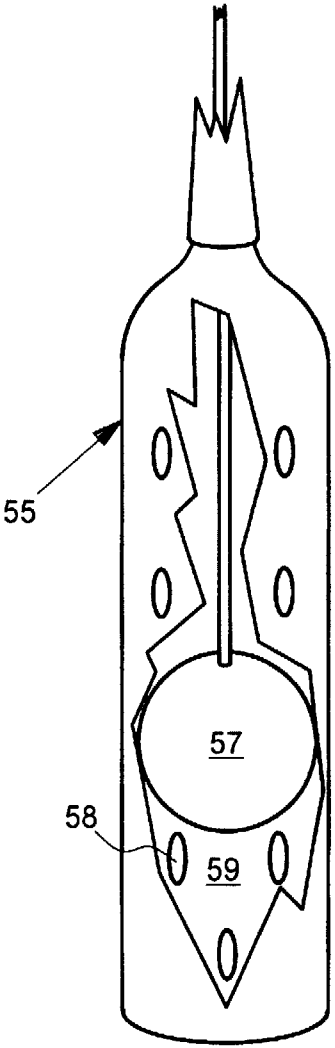
FIG. 5 is a detail cutaway perspective representational view of an alternate embodiment of the float indicator housing.

Referring to FIGS. 3 and 5, an alternate embodiment of tree watering device 50 includes filler portion 51 having filler discharge portion 52 in fluid communication with in reservoir R via flexible filler conduit 53. Filler portion 51 is formed of a funnel having a frusto-conical cross-section that tapers from an open top end to a tapered bottom end. Flexible filler conduit 53 is coupled to filler discharge portion 52 or manufactured integrally as an extension of filler portion 51.

Flexible indicator conduit 54 extends along and in the alternate embodiment is attached to flexible filler conduit 53. The lower end of flexible indicator conduit 54 is coupled to indicator float housing 55. Flexible indicator stem 56 extends through flexible indicator conduit 54. The lower end of flexible indicator stem 56 is attached to indicator float 57 which is slideably engaged and travels in a substantially vertical axis within indicator float housing 55. Flexible indicator stem 56 extends from the upper open end of flexible indicator conduit 54 indicating the relative level of the water in reservoir R.

Referring to FIG. 6, indicator float housing 55 has a single inner chamber 59 containing indicator float 57 attached at the lower end flexible indicator stem 56. Indicator float housing 55 is configured having a plurality of housing apertures 58 which allow a free flow of water contained in reservoir R through the outer wall of indicator float housing 55.

Referring again to FIGS. 1, 2 and 4, in use, tree watering device 10 is attached to tree T by means of straps 25 and 26. Indicator float housing 16 is either inserted into reservoir R or is formed integrally as a part of the reservoir portion of a tree stand. Water is added to reservoir R through filler portion 11. Water passes through filler discharge portion 12 into flexible filler conduit 13 and into upper chamber 18 of float indicator housing 16. Water impinges against partition 20 and is discharged from upper chamber 18 through discharge apertures 22 into reservoir R. In the preferred embodiment of the invention, water is directed in a downward direction upon discharge from discharge apertures 22 by shroud 27.

As the water level rises in reservoir R water enters lower chamber 19 of float indicator housing 16 through inflow apertures 23. Indicator float 14 floats on the surface of the water within lower chamber 19 of float indicator housing 16. Flexible indicator stem 15 is pushed up through flexible filler conduit 13 indicating, by means of the relative extension of flexible indicator stem 15 at the upper open end of filler portion 11, the water level in reservoir R.

Referring to FIGS. 3 and 5, use of the alternate embodiment of tree watering device 50 is explained. Water is added reservoir R through filler portion 51. Water passes through filler discharge portion 52 into flexible filler conduit 53 directly into reservoir R.

As the water level rises in reservoir R water enters and rises within float indicator housing 55 through housing apertures 58. Indicator float 57 floats on the surface of the water within chamber 59 of float indicator housing 55. Flexible indicator stem 56 is pushed up through flexible indicator conduit 54 indicating, by means of the relative extension of flexible indicator stem 56 at the upper open end of flexible indicator conduit 54, the water level in reservoir R.

I claim:

1. A device for monitoring and maintaining the water level in a tree stand reservoir comprising:

a filler portion having a filler discharge portion;

a flexible filler conduit having first and second ends, the first end of the flexible filler conduit in fluid communication with the filler discharge portion;

an indicator float housing including an indicator float housing exterior wall having a plurality of apertures formed therein in fluid communication with the second end of the flexible filler conduit;

an indicator float slideably engaged within the indicator float housing and configured to allow the indicator float to travel freely along a substantially vertical axis within the indicator float housing; and a flexible indicator stem attached to the indicator float extending up through the flexible filler conduit for indicating, by means of the relative extension of the flexible indicator stem within the flexible filler conduit, the water level in the tree stand reservoir.

2. The device of claim 1 wherein the indicator float housing further comprises:

a partition located within the indicator float housing having a stem aperture through its cross section configured to permit the indicator stem to extend and retract through the stem aperture;

a first chamber defined by a first chamber exterior wall and the partition, the first chamber having at least one aperture through the first chamber exterior wall for passage of water to the reservoir; and a second chamber defined by a second chamber exterior wall and the partition, the second chamber having at least one aperture through the second chamber exterior wall for passage of water to and from the reservoir to the second chamber for buoyantly raising or lowering the indicator float, consistent with the level of water in the reservoir.

3. The device of claim 1 wherein the filler portion having a filler discharge portion further comprises a funnel having a frusto-conical cross-section that tapers from top to bottom.

4. The device of claim 1 wherein the flexible filler conduit is manufactured integrally as an extension of the filler portion.

5. The device of claim 1 further comprising a shroud or other means for directing discharge of water from a first chamber aperture in a downward direction.

6. The device of claim 1 further comprising means for attaching the device to the tree.

7. The device of claim 6 wherein the means for attaching the device to the tree further comprises a strap attached along the length of the flexible filler conduit.

8. The device of claim 2 wherein the first chamber comprises an upper chamber and the second chamber comprises a lower chamber.

9. The device of claim 2 wherein the first chamber comprises an outer chamber and the second chamber comprises an inner chamber.

10. The device of claim 1 wherein the indicator float housing is permanently attached to the reservoir.

11. A device for monitoring and maintaining the water level in a tree stand reservoir comprising:

a filler portion having a filler discharge portion;

a flexible filler conduit having first and second ends, the first end of the flexible filler conduit in fluid communication with the filler discharge portion;

a flexible indicator conduit having first and second ends, extending parallel with the flexible filler conduit;

an indicator float housing coupled to the second end of the flexible indicator conduit;

an indicator float slideably engaged within the indicator float housing and configured to allow the indicator float to travel freely along a substantially vertical axis within the indicator float housing; and a flexible indicator stem attached to the indicator float extending up through the flexible indicator conduit for indicating, by means of the relative extension of the flexible indicator stem within the flexible indicator conduit, the water level in the tree stand reservoir.

12. The device of claim 11 wherein the filler portion having a filler discharge portion further comprises a funnel having a frusto-conical cross-section that tapers from top to bottom.

13. The device of claim 11 wherein the flexible filler conduit is manufactured integrally as an extension of the filler portion.

14. The device of claim 11 further comprising means for attaching the device to the tree.

15. The device of claim 14 wherein the means for attaching the device to the tree further comprises a strap.

16. The device of claim 11 wherein the indicator float housing is permanently attached to the reservoir.

* * * * *